US006761048B2

(12) United States Patent
Okamoto

(10) Patent No.: US 6,761,048 B2
(45) Date of Patent: Jul. 13, 2004

(54) WELT-PROCESSED KNITTED FABRIC AND WELT PROCESSING METHOD

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/472,968

(22) PCT Filed: Mar. 22, 2002

(86) PCT No.: PCT/JP02/02814

§ 371 (c)(1),
(2), (4) Date: Sep. 26, 2003

(87) PCT Pub. No.: WO02/077344

PCT Pub. Date: Oct. 3, 2002

(65) Prior Publication Data

US 2004/0093908 A1 May 20, 2004

(30) Foreign Application Priority Data

Mar. 26, 2001 (JP) ..... 2001-088884

(51) Int. Cl.[7] ..... D04B 1/24
(52) U.S. Cl. ..... 66/64; 66/172 R
(58) Field of Search ..... 66/64, 169 R, 66/170, 171, 175, 176, 172 R, 197, 70

(56) References Cited

U.S. PATENT DOCUMENTS 4,548,057 A * 10/1985 Essig ..... 66/172 R
5,456,096 A 10/1995 Mitsumoto et al.
5,669,244 A * 9/1997 Okuno ..... 66/64
5,836,177 A * 11/1998 Okuno et al. ..... 66/64
6,070,438 A * 6/2000 Okuno et al. ..... 66/172 R
6,119,050 A * 9/2000 Okuno et al. ..... 66/64
6,571,584 B1 * 6/2003 Okayama ..... 66/64
6,658,898 B2 * 12/2003 Okamoto ..... 66/64

FOREIGN PATENT DOCUMENTS

JP 3-75656 B2 12/1991
JP 9-310254 A 12/1997

* cited by examiner

*Primary Examiner*—Danny Worrell
(74) *Attorney, Agent, or Firm*—Rothwell, Figg, Ernst & Manbeck, P.C.

(57) ABSTRACT

A loop of a row of binding-off loops is formed with finer yarn than yarn used in a rib knitted fabric part. Also, a binding-off loop of the row of binding-off loops formed following a final loop of an odd wale of a knitted fabric at an end thereof and the binding-off loop of the row of binding-off loops formed following a final loop of an even wale of the knitted fabric are overlapped with the adjacent final loops on the underside thereof and also the binding-off loop formed following the final loop of the odd wale and the binding-off loop formed following the final loop of the even wale are intersected with each other. This can prevent the binding-off loops different in orientation from coming out in the bound off part, thus enabling the bound off part to be formed in a similar appearance to the set-up part.

6 Claims, 13 Drawing Sheets

43

WELT-PROCESSED KNITTED FABRIC AND WELT PROCESSING METHOD

CROSS REFERENCE TO RELATED APPLICATION

This application is a 35 USC § 371 National Phase Entry Application from PCT/JP02/02814, filed Mar. 22, 2002, and designating the U.S.

TECHNICAL FIELD

The present invention relates to a bound-off fabric with its final loops bound off to prevent loosening of the loops by using a flat knitting machine comprising at least a pair of front and back needle beds disposed opposite to each other in front and back and having a number of knitting needles, and to the binding-off process.

BACKGROUND ART

In a method using a flat knitting machine wherein a knitted part of a desired structure/pattern (which is hereinafter called "the ground part") is formed following a so-called set-up course knitted at a starting end of a knitted fabric and, then, final loops at a finishing end of the knitted fabric are bound off by a so-called binding-off process to prevent loosening of the loops of the knitted fabric, the knitted fabric can be formed on the flat knitting machine without any need for the process of preventing loosening of the loops after knitting. The set-up knitting comprises a set-up course knitting for knitting a set-up course by feeding yarn alternately to the needles of front and back needle beds and a loosened loop prevention knitting for preventing loosening of the loops by feeding the yarn continuously to the loops retained on the needles on the front and back needle beds following the set-up course knitting. By using the set-up course knitting noted above for knitting an end portion of the knitted fabric on the set-up side, the step-up part is kept without loosening. At an finishing end of the knitted fabric, a binding-off loop of a row of binding-off loops is formed following a final loop of a final course of the ground part of the fabric. Then, a newly formed loop is overlapped with a final loop in an adjacent wale, to form a double loop. Thereafter, a loop of the next course is formed following the double loop. The knitting mentioned above is repeated to form a row of binding-off loops which are continuously arrayed from one end of the knitted fabric to the other end, which is called "the binding-off process". The binding-off process enables a finishing end portion of the knitted fabric to be kept from loosening.

The binding-off loop of the row of binding-off loops formed in the process of the binding-off process is overlapped with the final loop of an adjacent wale and is held in a direction in which it is intersected with the loop of the ground part. In the knitted fabric bound off by this conventional binding-off process, the loops of the row of the binding-off loops different in orientation come out on the bound off part of the fabric. Thus, for example when a belt-shaped knitted fabric with its set-up part and the bound off part formed close to each other is knitted, the difference in knitting structure between the set-up part and the bound off part is easily recognized and thus the difference in appearance between the set-up part and the bound off part is apparently outstanding.

DISCLOSURE OF THE INVENTION

To reduce or minimize the problems mentioned above, the present invention provides a knitted fabric bound off by forming rows of binding-off loops in such a manner that a binding-off loop of a row of binding-off loops formed following a final loop of a rib knitted fabric with a predetermined number of front loops and back loops arranged alternately is overlapped with an adjacent final loop to form a double loop and a binding-off loop of a row of binding-off loops formed following the double loop continue from one end of a binding-off region to the other end thereof, wherein the loop of the row of binding-off loops is formed with finer yarn than yarn used in the rib knitted fabric part, and wherein the binding-off loop of the row of binding-off loops formed following the final loop of an odd wale of the knitted fabric at an end thereof and the binding-off loop of the row of binding-off loops formed following the final loop of an even wale of the knitted fabric are overlapped with the adjacent final loops on the underside thereof and also the binding-off loop formed following the final loop of the odd wale and the binding-off loop formed following the final loop of the even wale are intersected with each other.

It is preferable that the binding-off loop is formed with yarn of finer yarn count than the yarn used for knitting the rib knitted part or with yarn smaller in number of yarn ends than the yarn used for knitting the rib knitted part.

The binding-off loop may be formed with elastic or stretch yarn.

Also, the present invention provides a binding-off process of a rib knitted fabric at an end thereof using a flat knitting machine comprising at least a pair of first and second needle beds which are displaced opposite to each other in front and back and have each a large number of needles, between which a needle bed gap is formed, and at least either of which is racked laterally, and at least one yarn feeder for feeding yarn to the needles of the needle beds, the binding-off process comprising the steps:

(1) of dividing loops of a final course of the knitted fabric into a first loop group retained on needles of the first needle bed and a second loop group retained on needles of the second needle bed; and (2) of repeating at least the following steps a, b, c starting at one lateral end of the knitted fabric:

a) of feeding finer yarn than yarn used for the rib knitted part to a needle on the first needle bed retaining a final loop of the first loop group and to a needle on the second needle bed retaining a final loop of the second loop group, to form next new loops on those needles;

b) of transferring a binding-off loop formed following a loop of the first loop group and a binding-off loop formed following a loop of the second loop group between the first and second needle beds in such a manner as to be bound with each other, so that they are intersected with each other; and c) of overlapping a binding-off loop formed following the loop of the first loop group with an adjacent loop of the first loop group and overlapping a binding-off loop formed following the loop of the second loop group with an adjacent loop of the second loop group.

According to the construction of the present invention mentioned above, the binding-off process is performed using finer yarn than yarn used for knitting the rib knitted part, such as yarn of fine yarn count or yarn of a reduced number of yarn ends, or an elastic or stretch yarn. The binding-off loop formed following the final loop of the first loop group and the binding-off loop formed following he final loop of the second loop group are interested with each other, to bind off the knitted fabric. The binding-off loops of the first row of binding-off loops formed following the final loop are overlapped with adjacent loops of the first loop group and the binding-off loops of the second row of binding-off loops formed following the final loop are overlapped with adjacent loops of the second loop group in such a manner that they are located on the underside of the final loops of the knitted fabric when the knitting of the knitted fabric is completed. Thus, those binding-off loops are hidden under the final loops of the knitted fabric. The binding-off loops formed following the final loops in an odd wale of the knitted fabric and the binding-off loops formed following the final loops in an even wale of the knitted fabric are transferred between the front and back needle beds so that the binding-off loops are intersected with each other. This can prevent the binding-off loops from coming out on the front side of the bound off part, thus enabling the bound off part to be formed in a similar appearance to the set-up part.

Also, the present invention provides a binding-off process of a rib knitted fabric at an end thereof using a flat knitting machine comprising at least a pair of first and second needle beds which are displaced opposite to each other in front and back and have each a large number of needles, between which a needle bed gap is formed, and at least either of which is racked laterally, and at least one yarn feeder for feeding yarn to the needles of the needle beds, the binding-off process comprising the steps:

(1) of dividing loops of a final course of the rib knitted fabric into a first loop group retained on needles of the first needle bed and a second loop group retained on needles of the second needle bed;

(2) of forming at least two rows of binding-off loops by using finer yarn than yarn used for the rib knitted part, with at least a final loop of the first loop group in a wale of the knitted fabric at a lateral end thereof and a final loop of the second loop group in the wale of the knitted fabric at the lateral end thereof as origins; and (3) of overlapping the binding-off loops, which are formed in such a manner that while the rows of binding-off loops are formed, the rows of the binding-off loops are extended in zigzag from the first loop group to the second loop group and vise versa and intersected with each other, with the opposite final loops of the knitted fabric.

According to the construction of the present invention mentioned above, the binding-off process is performed using finer yarn than yarn used for knitting the rib knitted part following the final loop of the rib knitted fabric, such as yarn of fine yarn count or yarn of a reduced number of yarn ends, or an elastic or stretch yarn. At least two rows of binding-off loops are formed, with the loops of the first and second wales at the lateral sides as the origins. The rows of the binding-off loops are extended in zigzag from the first loop group to the second loop group and vise versa. Also, the binding-off loops are intersected with each other and also overlapped with the final loops of the knitted fabric so that when the knitting of the knitted fabric is completed, the binding-off loops can be hidden under the final loops of the knitted fabric.

The knitted fabric may be a tubular fabric with its first knitted fabric and second knitted fabric knitted to be continuously joined at both ends thereof and it is preferable that while the first knitted fabric is bound off, the final loop of the second knitted fabric is held on either of the first and second needle beds so that the first knitted fabric can be knitted, and after completion of the binding-off process of the first knitted fabric, the second knitted fabric is bound off.

BEST MODE FOR CARRYING OUT THE INVENTION

An embodied example of the present invention will be described below with reference to the accompanying drawings. In the illustrated embodiment, a two-bed flat knitting machine is used which comprises a pair of front and back needle beds which have a number of needles received to be freely movable back and forth in needle grooves formed in upper surfaces of the needle beds and are disposed in front and back with their heads disposed opposite to each other, and a yarn feeder movable in reciprocation over a needle bad gap between the front and back needle beds along a guide rail provided in a longitudinal direction of the needle beds. A three- or four-bed flat knitting machine which further comprises an upper auxiliary needle bed disposed over at least either of the pair of lower front and back needle beds may be practicably used in the present invention. In the illustrated embodiment, the two-bed flat knitting machine wherein the back needle bed is movable relative to the front needle bed (hereinafter, this movement is referred to "racking") is used.

First Embodiment

Figure 1:
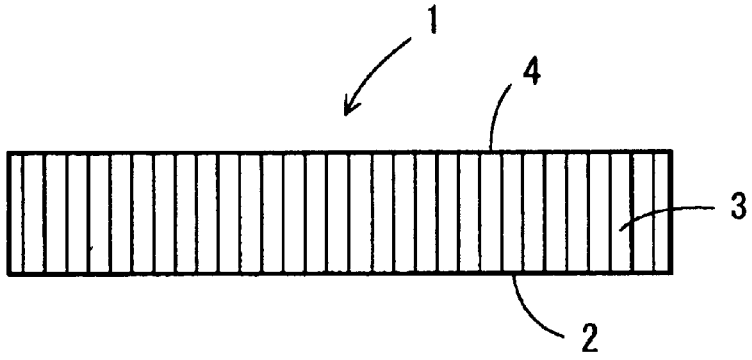
FIG. 1 is a view showing a knitted fabric as was bound off.

Referring to FIG. 1 and FIGS. 2–5 showing knitting course diagrams, a first embodiment according to which a 2×2 rib knitted fabric is bound off is described. FIG. 1 shows a belt-shaped fabric 1 which is a knitted object. The knitting of the belt-shaped fabric 1 starts at a set-up part 2 in a set-up knitting. Then, after a rib knitted part 3 knitted with a desired knitting structure is formed, a terminal end 4 of the knitted fabric is bound off. Since the knitting of the rib knitted part 3 knitted continuously from the set-up knitting is performed in the same manner as in the conventional knitting, the description starts from the course 1 of FIG. 2 where the knitting from the set-up part 2 to the rib knitted part 3 is already completed. In the knitting course diagrams, the horizontal arrows indicate the knitting direction, and the vertical arrows indicate the direction for the loops to be transferred. In the following description, the phrase of "a go-forward direction of the binding-off process" means a direction in which the band-shaped fabric 1 is knitted from right end to left end. Also, the position at which the front and back needle beds are correctly positioned opposite to each other is herein defined as a racking origin, and the numerals shown at the right side of the illustration refer to pitch at which the back needle bed is racked.

In the course 1, final loops of the 2×2 rib knitted fabric where front loops and back loops are alternated on every two wales are retained on the needles of the front and back needle beds. Specifically, the front loops are retained on the needles B, C, F, G, J, K of the front needle bed FB, and the back loops are retained on the needles a, d, e, h, i, l of the back needle bed BB. In the courses 2–4, a tubular knitting, which corresponds to a loosened loop prevention knitting of the set-up knitting, is performed. For the tubular knitting, a yarn is fed from a yarn feeder 10 to the needles retaining the front loops in the course 2, then to the needles retaining the back loops in the course 3, and then to the needles retaining the front loops in the course 4. In the course 5, the loops on the needles B, F, J of the front needle bed FB are transferred to the back needle bed BB. In the course 6, after the back needle bed is racked leftwards one pitch, the loops as were transferred in the course 5 are transferred to the needles of the front needle bed FB. As a result of this, the front loops are retained on alternate needles of the front needle bed FB. In the course 7, after the back needle bed BB is racked rightwards one pitch, the loops on the needles a, e, i of the back needle bed BB are transferred to the needles of the front needle bed FB. In the course 8, after the back needle bed BB is racked back to the original position, the loops as were transferred in the course 7 are transferred to the needles of the back needle bed BB. As a result of this, the back loops are retained on alternate needles of the back needle bed BB.

From the course 9, the binding-off process is performed by using another yarn feeder 11 different from the yarn feeder 10 used for the knitting of the rib knitted part 3. The yarn feeder 11 used for the binding-off process feeds a yarn of fine yarn count, as compared with the yarn feeder 10. For convenience of explanation, in the description on the knitting from the course 9, the final loops of the odd wales from the left end of the knitted fabric retained on the needles A, C, E, G, I, K of the front needle bed FB in the course 9 are called "loops of the front loop group" and depicted by white circles. Similarly, the final loops of the even wales retained on the needles b, d, f, j, l of the back needle bed BB are called "loops of the back loop group" and depicted by black circles. In the course 9, a loop 12 of the back loop group located at a most upstream side (right side) with respect to the go-forward direction of the binding-off process and retained on the needle I of the back needle bed BB is transferred to the needle L of the front needle bed FB. In the course 10, a loop 13 of the next course is formed on the loop 12 by using the yarn feeder 11 used for the binding-off process. In the course 11, the loop 13 is transferred back to the needle I of the back needle bed BB. In the course 12, after the back needle bed BB is racked leftwards two pitches, the loop 13 is transferred to the needle J of the front needle bed FB. In the course 13, a loop 14 of the front loop group located at the right end retained on the needle K of the front needle bed FB is transferred to the needle k of the back needle bed BB. In the course 14, a loop 15 of the next course is formed on the loop 14. In the course 15, the loop 15 is transferred back to the needle K of the front needle bed FB. In the course 16, after the back needle bed BB is racked two pitches, the loop 15 is transferred to the needle i of the back needle bed BB. At this time, since the yarn bridges over between the loop 13 retained on the needle J of the front needle bed FB and a loop 16 the needle j of the back needle bed BB, when the loop 15 is transferred to the needle i of the back needle bed, the loop of the front loop group and the loop of the back loop group intersects with each other. In the course 17, after the back needle bed BB is racked back to the original position, the loop 16 retained on the needle j is transferred to the needle J of the front needle bed FB to overlap it with the loop 13, so as to form a double loop. In the course 18, the yarn is fed to the needle J to retain a binding-off loop 17 of the next course on the double loop thus formed. In the course 19, the loop 17 is transferred to the needle i of the back needle bed BB. In the course 20, after the back needle bed BB is racked leftwards two pitches, the loop 17 is transferred to the needle H of the front needle bed FB. At this time, the loop 17 as was transferred to the needle H is transferred to the front needle bed FB, passing over the yarn bridging over between the loop 15 on the needle i and a loop 18 on the needle I. In the course 21, after the back needle bed BB is racked back to the original position, the loop 18 is transferred to the needle i of the back needle bed BB to overlap it with the loop 15, so as to form a double loop. In the course 22, the yarn is fed to the needle i of the back needle bed BB to form a loop 19 of the next course. In the course 23, a newly formed loop 19 is transferred to the needle I of the front needle bed FB. In the course 24, after the back needle bed BB is racked rightwards two pitches, the loop 19 is transferred to the needle g of the back needle bed BB. The knitting of the courses 17–24 is repeatedly performed while the loops to be knitted are sequentially transferred in the go-forward direction of the binding-off process, whereby the loops of the front loop group and the loops of the back loop group are alternately overlapped with the final loops of the knitted fabric, bound off to prevent from being loosened and knocked over from the needles.

In the knitted fabric bound off by the knitting mentioned above, the binding-off loop 13 formed following the final loops of the back loop group and the binding-off loop 15 formed following the final loops of the front loop group are intersected with each other, and the binding-off loops 17 and 19 are also intersected with each other. These binding-off loops 13, 15, 17, 19 of a row of binding-off loops are overlapped in such a manner that they are located on the underside of the final loops 16, 18 of the knitted fabric when the knitting of the knitted fabric is completed. Thus, the binding-off loops 13, 15, 17, 19 are hidden under the final loops 16, 18 of the knitted fabric. Thus, the binding-off loops different in orientation hide behind the final loops and do not come out on the front side of the knitted fabric at a terminal end thereof. Also, the binding-off loops in the bound off part are formed by using the yarn of finer yarn count than the yarn used for the knitting of the rib knitted part 3. When a force is applied to the row of binding-off loops in a height direction of the loop, elongation of the loops of the same length is influenced by thickness of the yarn forming the loop of the next course inserted in the final loop. In the case of a loop of fine yarn, when a force of a direction for the loop to be elongated in a height direction thereof is applied to the loop, almost part of the loop length is converted into elongation of the loop in the height direction. Accordingly, the loop of fine yarn is excellent in stretch in the height direction. On the other hand, in the case of a loop of thick yarn, when the same force is applied to the loop of thick yarn, a part of the loop length is converted into elongation of the loop in the widthwise direction. Accordingly, the loop of thick yarn is inferior in stretch in the height direction to the loop of fine yarn. Thus, when the finer yarn than the yarn used for the knitting of the rib knitted part 3 is used for the binding-off knitting, the bound off part is increased in stretch. Further, even when the bound off part is shrunk to cause loosening of the row of binding-off loops, since the row of binding-off loops are hidden under the final loops, there is no possibility that the appearance of the bound off part may be impaired.

When the tubular knitting is performed before the binding-off process is performed, as in the illustrated embodiment, the bound off part is knitted in the order of the rib knitted part—the tubular knitting (the loosened loop prevention courses 2–4)—the binding off process (the courses 5–24). Since the binding-off loops formed in the binding off process are hidden under the final loops of the knitted fabric, the bound off part is the same as a bound off part that is knitted in reverse order to the set-up knitting which is knitted in the order of the set-up knitting—the loosened loop prevention courses (tubular knitting)—the rib knitted part. As a result, substantially the same knitting structure as the set-up knitted part is formed in the bound off part.

Figure 2:
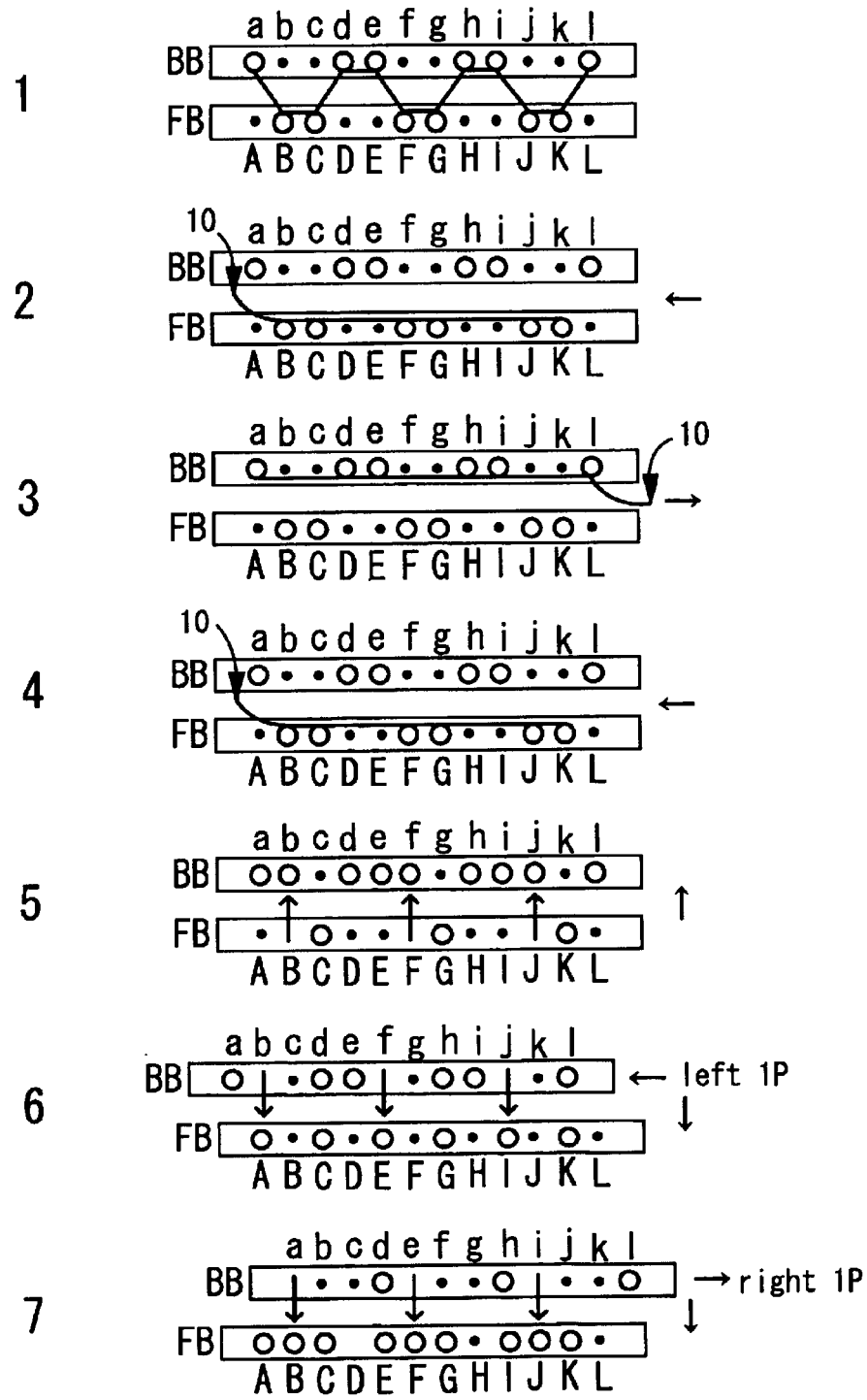
FIG. 2 is a knitting course diagram showing a first embodiment.
Figure 6:
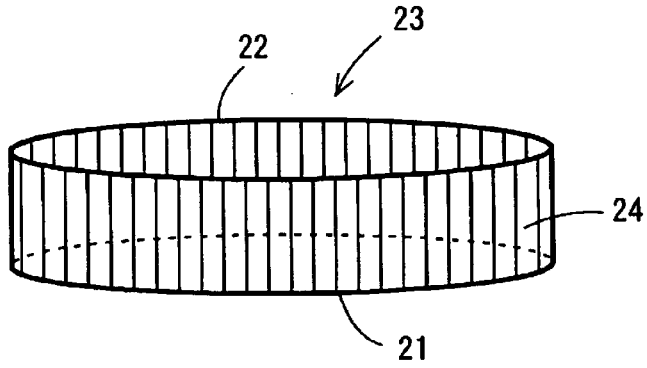
FIG. 6 is a view showing a tubular fabric as was bound off.
Figure 7:
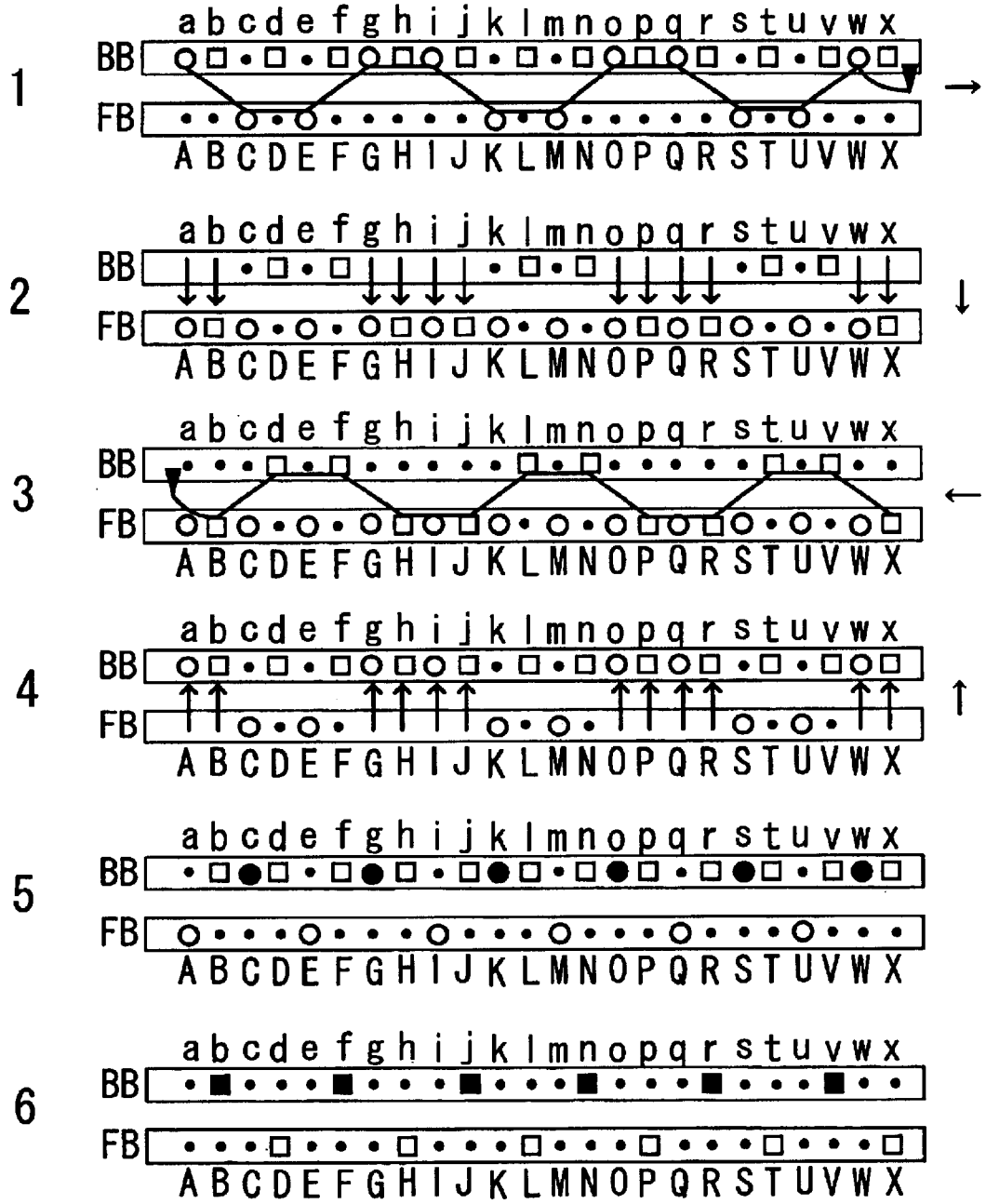
FIG. 7 is a knitting course diagram showing a variant of the first embodiment.
Figure 8:
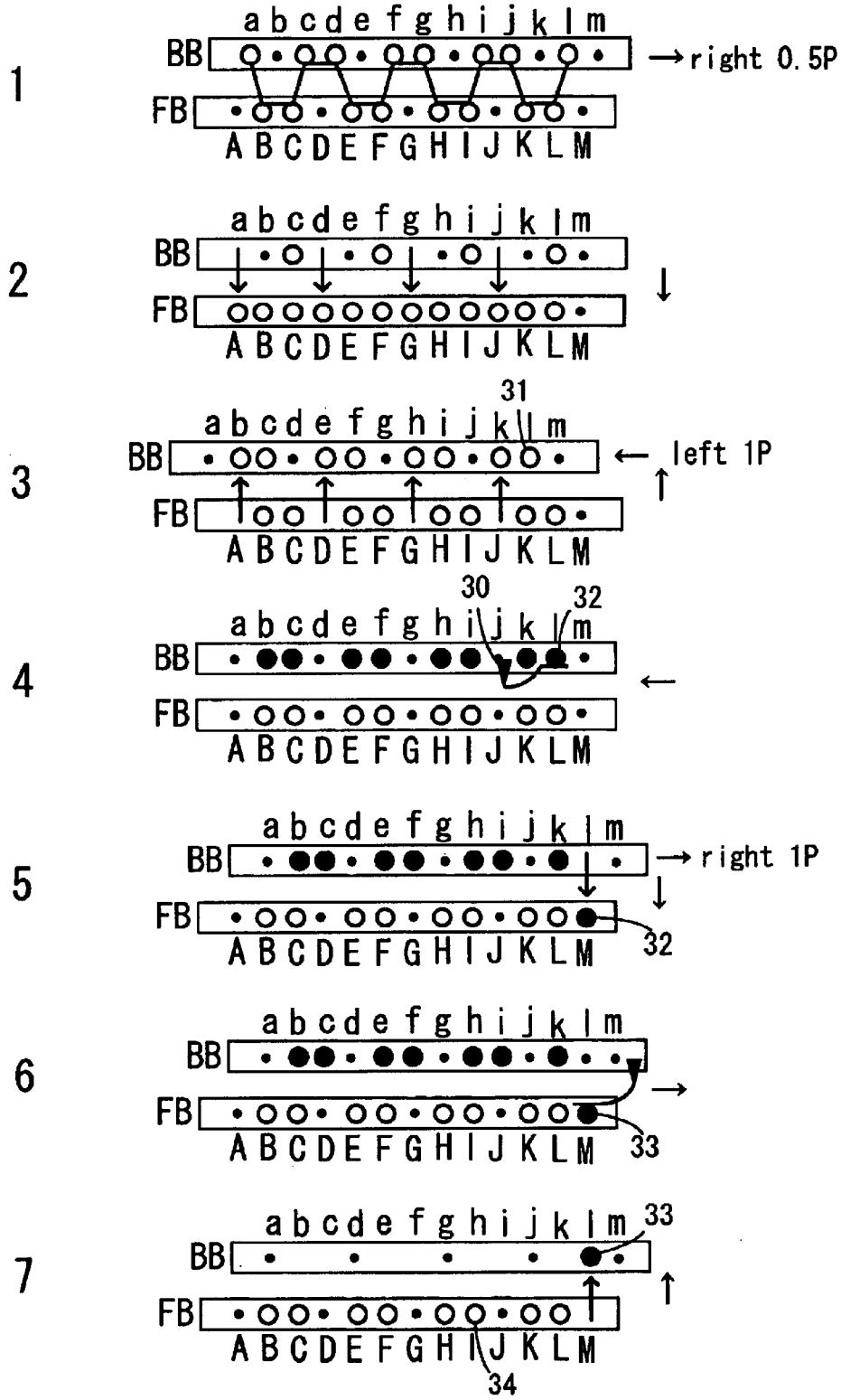
FIG. 8 is a knitting course diagram showing a second embodiment.
Figure 9:
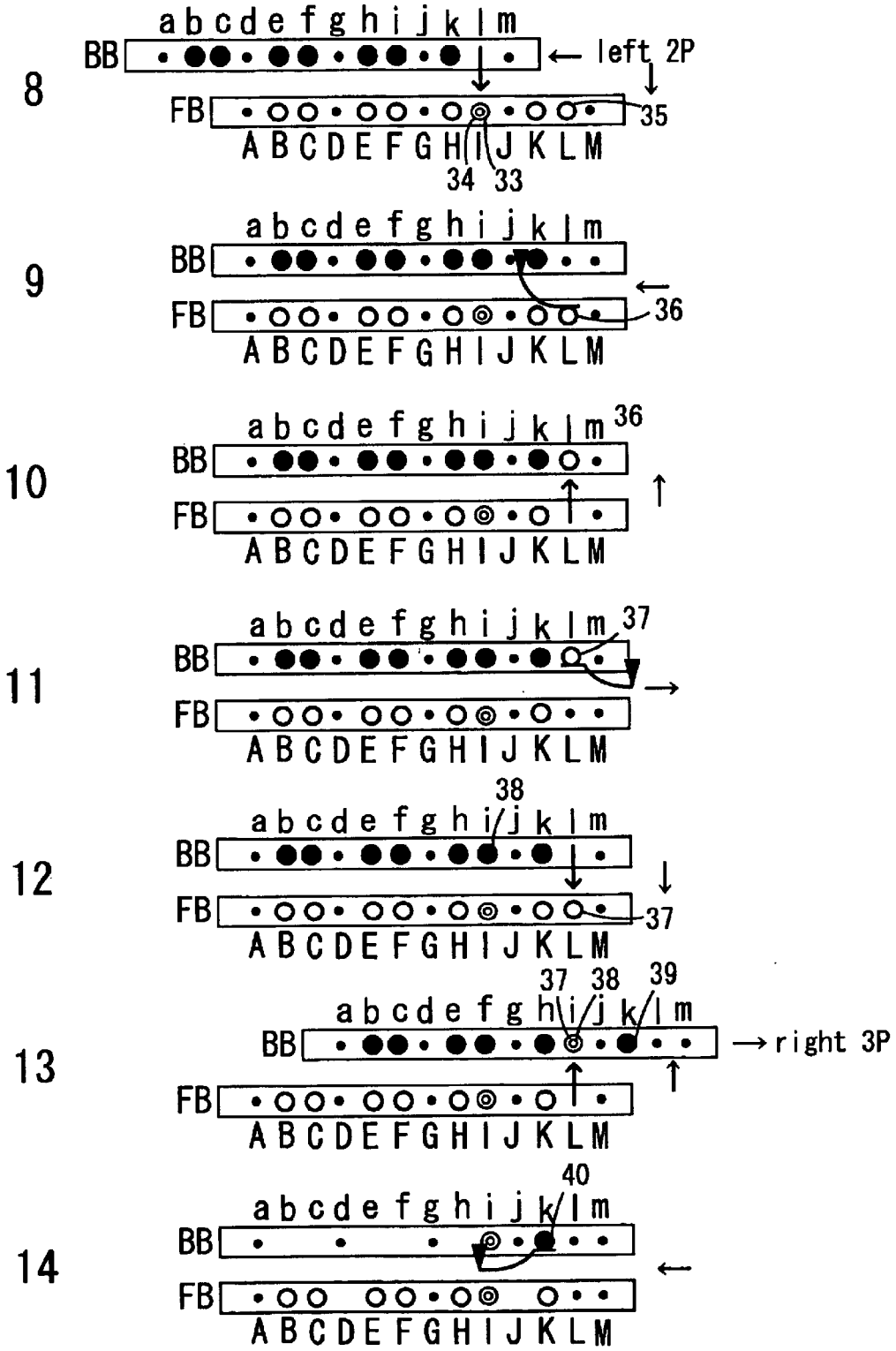
FIG. 9 is a knitting course diagram showing the second embodiment.
Figure 10:
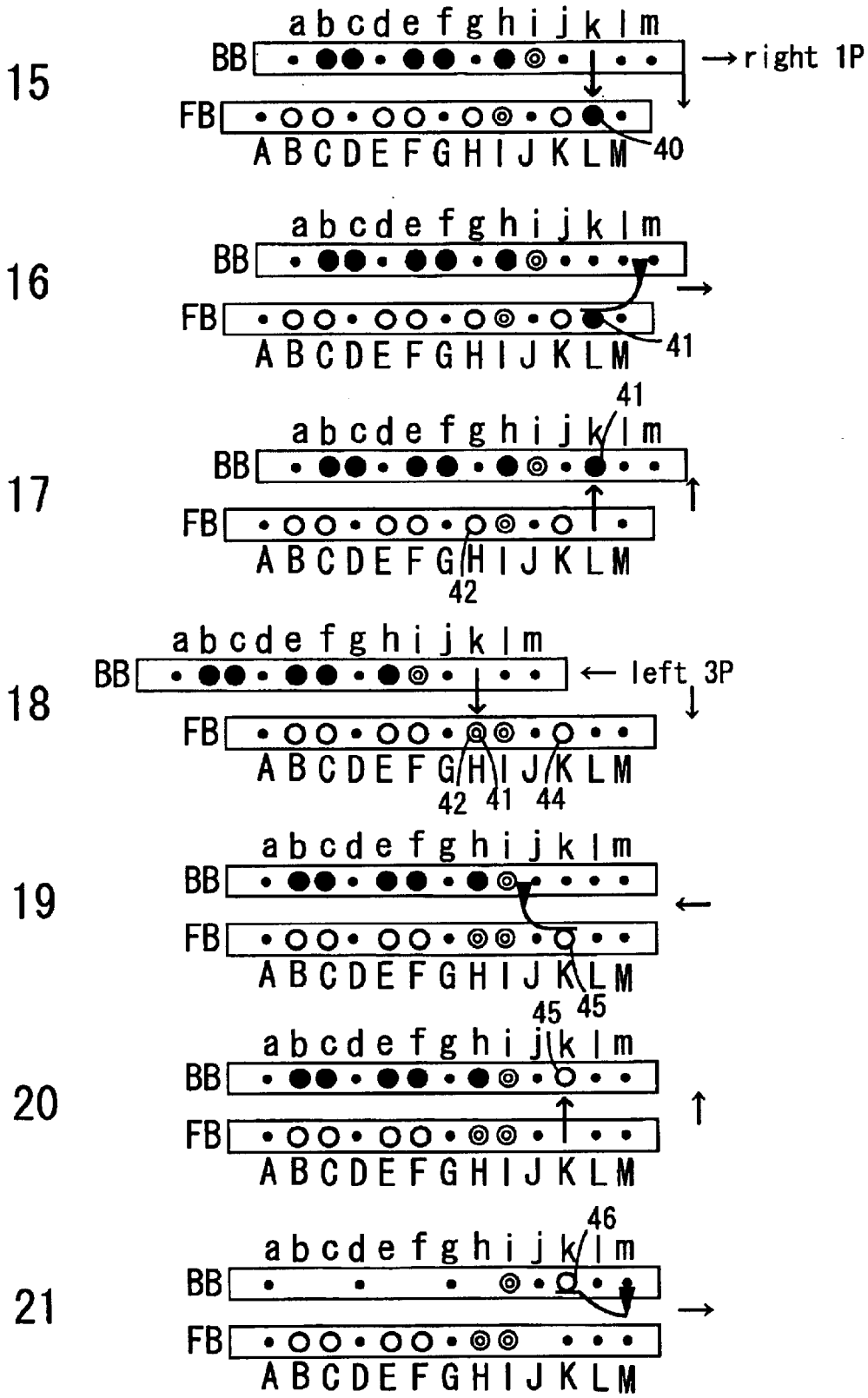
FIG. 10 is a knitting course diagram showing the second embodiment.
Figure 11:
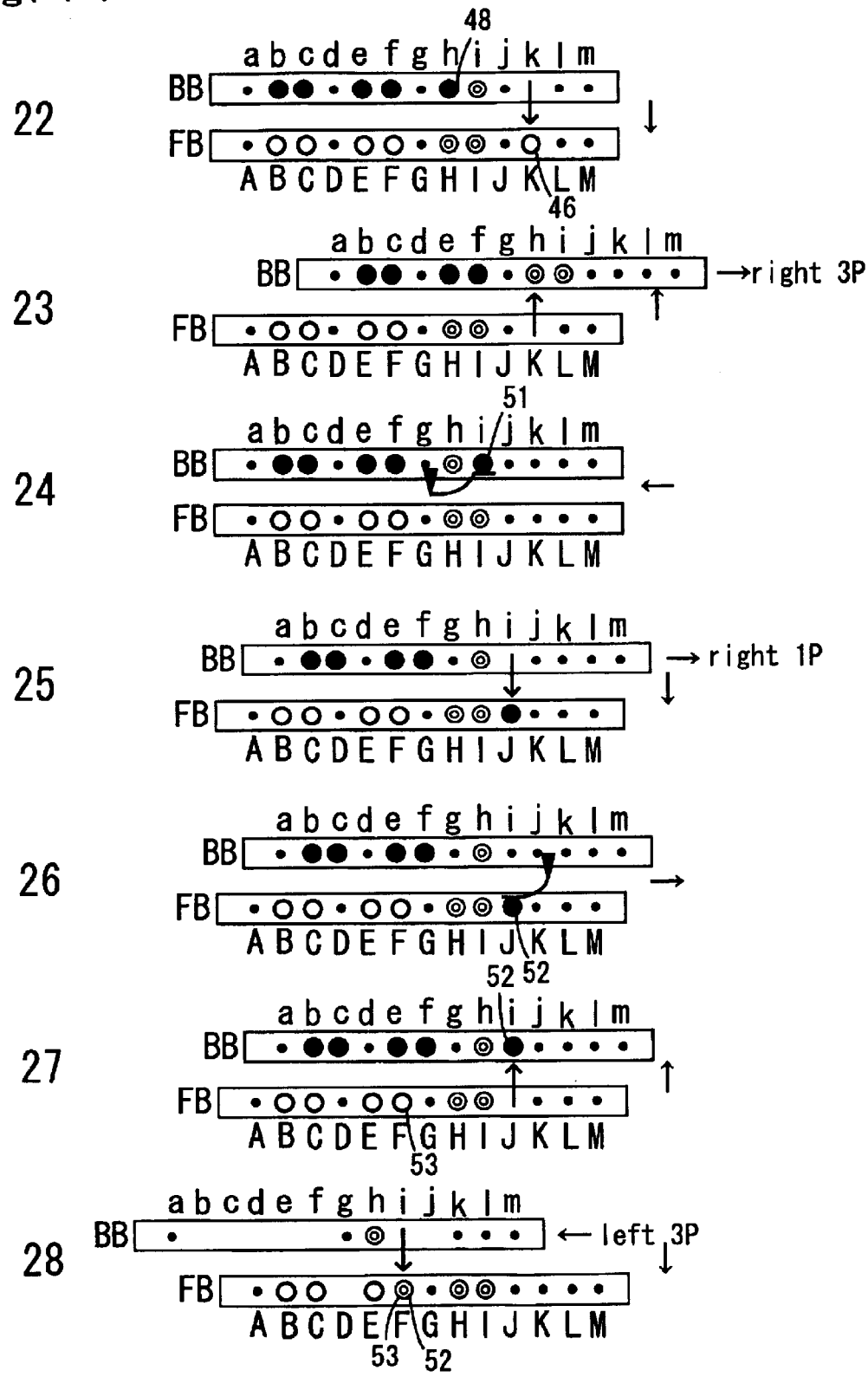
FIG. 11 is a knitting course diagram showing the second embodiment.
Figure 12:
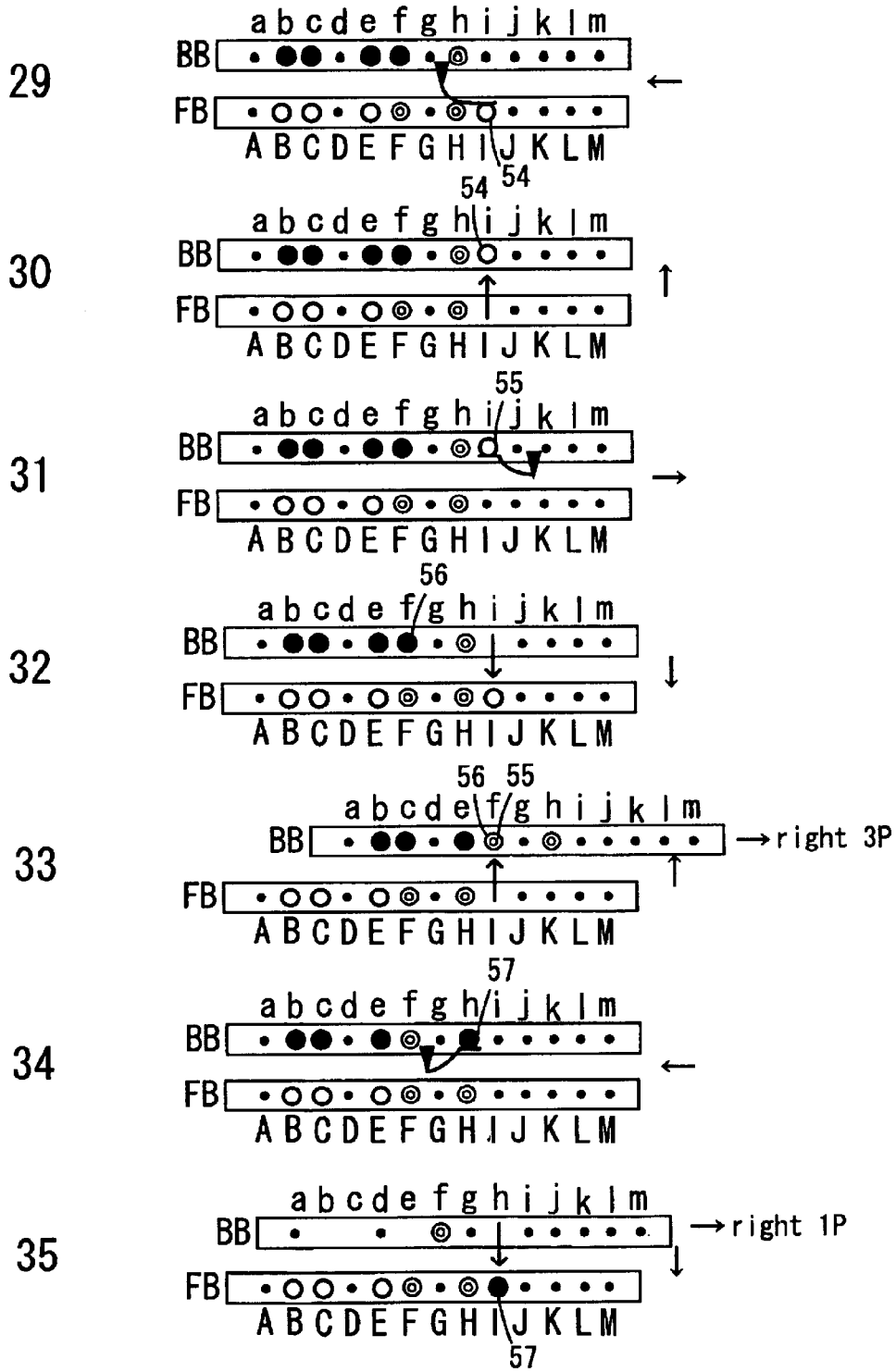
FIG. 12 is a knitting course diagram showing the second embodiment.
Figure 13:
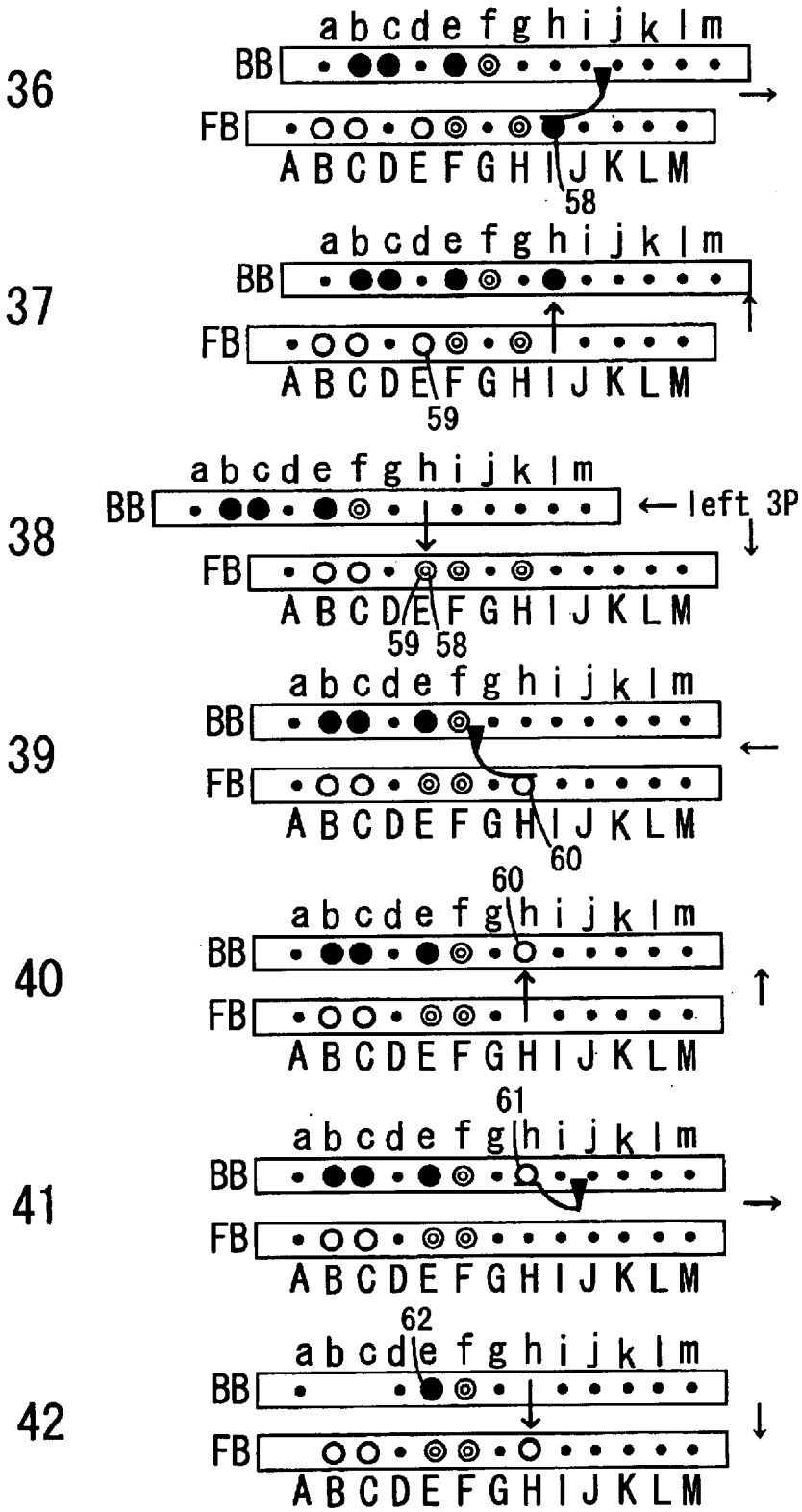
FIG. 13 is a knitting course diagram showing the second embodiment.
Figure 14:
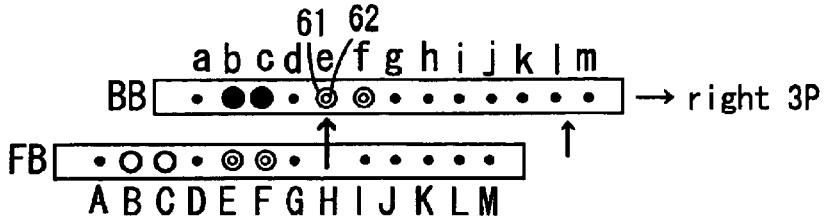
FIG. 14 is a knitting course diagram showing the second embodiment.

While in the embodiment illustrated above, the knitting for binding off a single layer of knitted fabric has been described above, the invention is also applicable to the knitting for binding off a tubular fabric 23 with its front and back knitted fabric parts are joined continuously at both ends thereof, as shown in FIG. 6. When the tubular fabric is bound off, the course knitting is performed as shown in FIG. 7. That is to say, in the course 1, the loops of the back knitted fabric part (squares) are all retained on alternate needles on the back needle bed BB to knit the front knitted fabric part 21. Sequentially, in the course 2, the loop transfer is performed. In the course 3, in the state in which the loops of the front knitted fabric part (white circles) are all retained on the needles of the front needle bed FB, the back knitted fabric part 22 is knitted. In the course 4, after the loop transfer is performed again, the knitting of the courses 1–4 is repeatedly performed to knit the tubular fabric 23. As the details of the knitting are described in detail by Japanese Patent Publication No. Hei 3(1991)-75656, further description thereon is omitted. After the knitting of the rib knitted part 24 is completed, the tubular knitting corresponding to the courses 2–4 of FIG. 2 is performed. Then, the loops of the back knitted fabric part (squares) are all retained on the back needle bed BB, as shown in the course 5, and the loops of the front knitted fabric part 1 are divided into the loops of the front loop group (white circles) retained on the needles of the front needle bed FB and the loops of the back loop group (black circles) retained on the needles of the back needle bed BB. The course 5 corresponds to the course 9 of FIG. 3. Subsequently, in the state in which the back knitted fabric part is retained on the needles of the back needle bed BB, the front knitted fabric part is bound off in accordance with the binding-off process of FIGS. 2–5. After completion of the binding-off process of the front knitted fabric part 21, the back knitted fabric part 22 is divided into the loops of the front loop group (white squares) retained on the needles of the front needle bed FB and the loops of the back loop group (black squares) retained on the needles of the back needle bed BB, as in the course 6 of FIG. 7. Then, the same binding-off process as the binding-off process of FIGS. 2–5 goes forward from left to right, whereby the tubular knitted fabric 23 is bound off.

Figure 3:
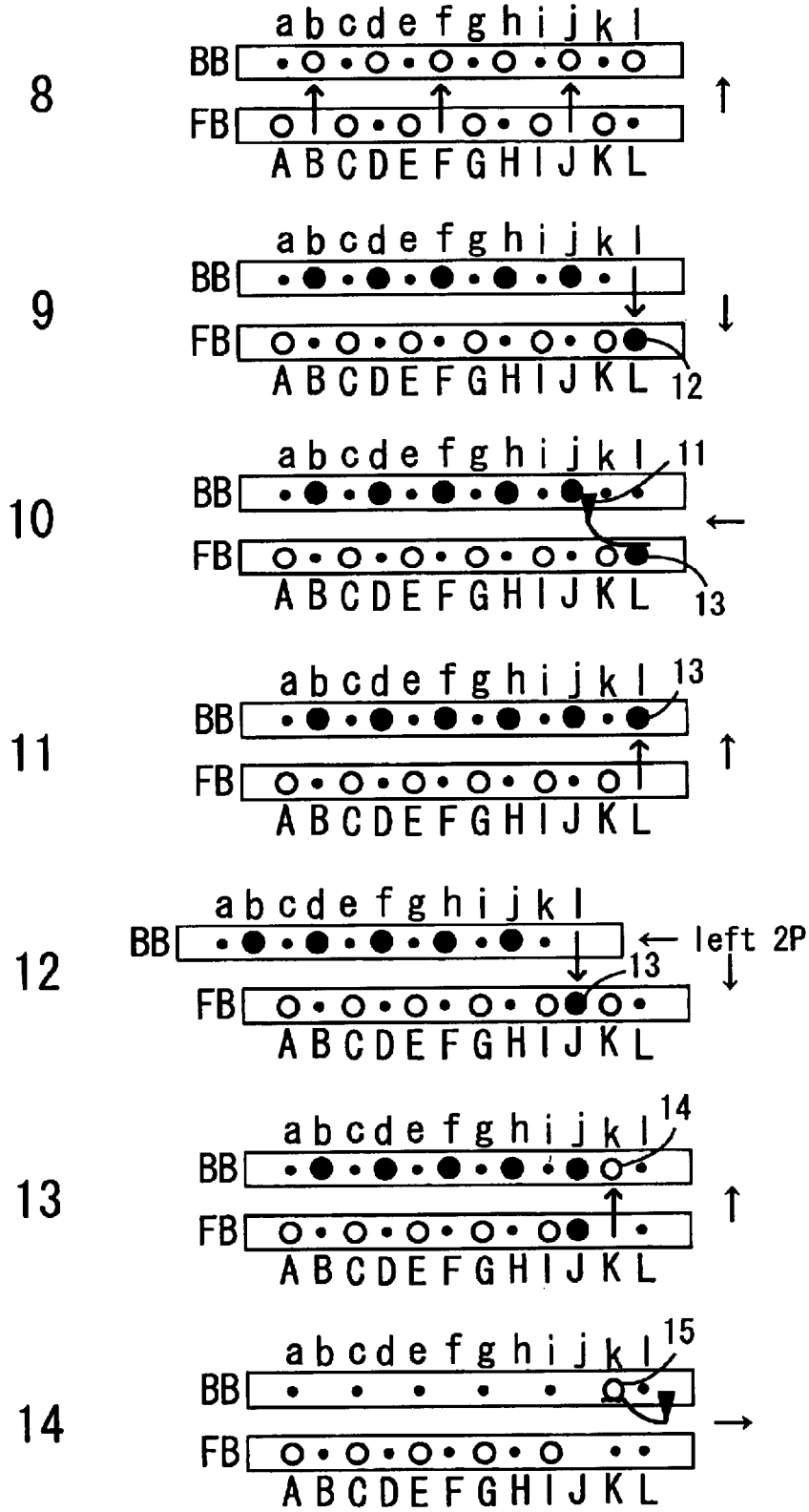
FIG. 3 is a knitting course diagram showing the first embodiment.
Figure 4:
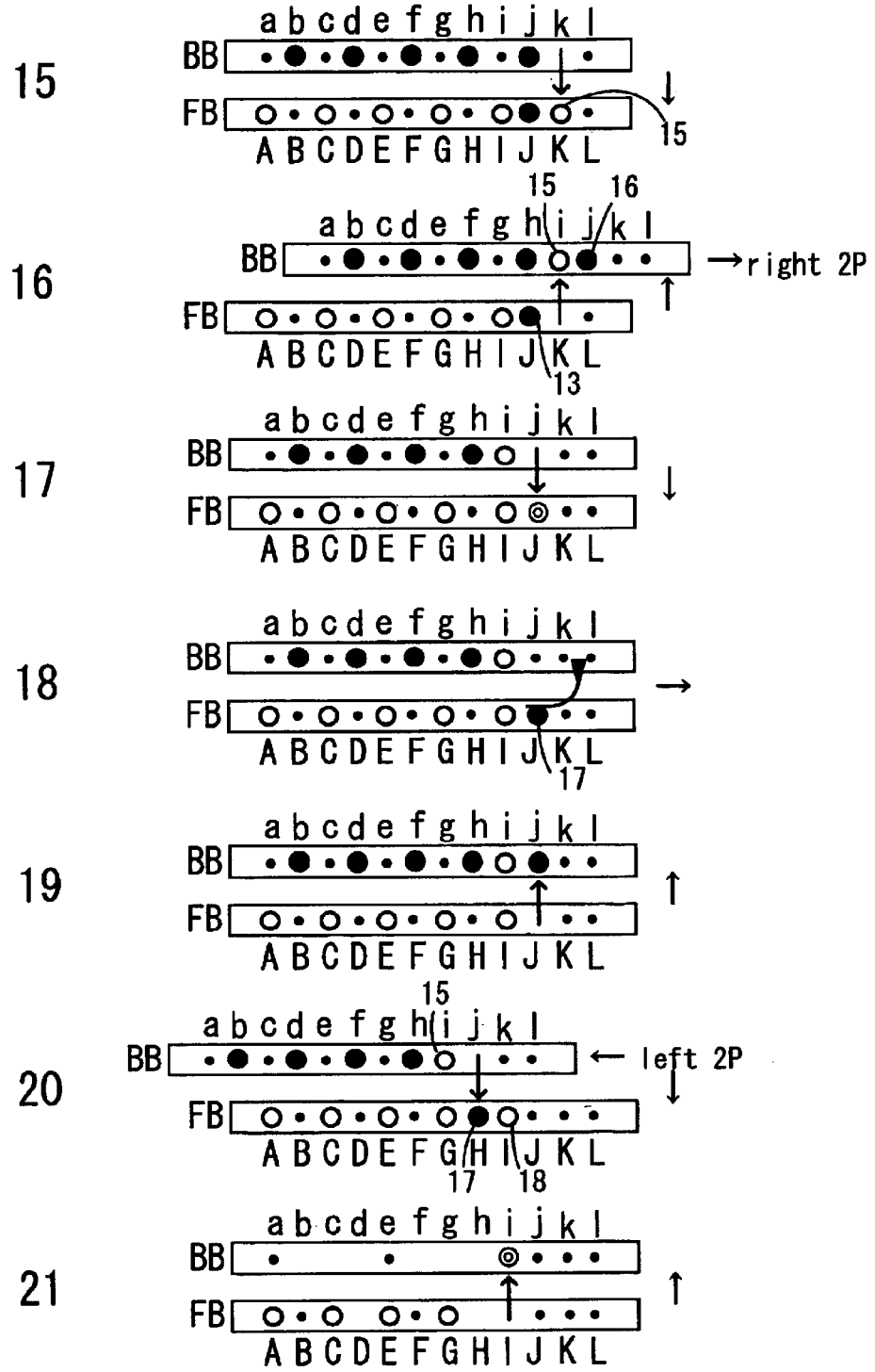
FIG. 4 is a knitting course diagram showing the first embodiment.
Figure 5:
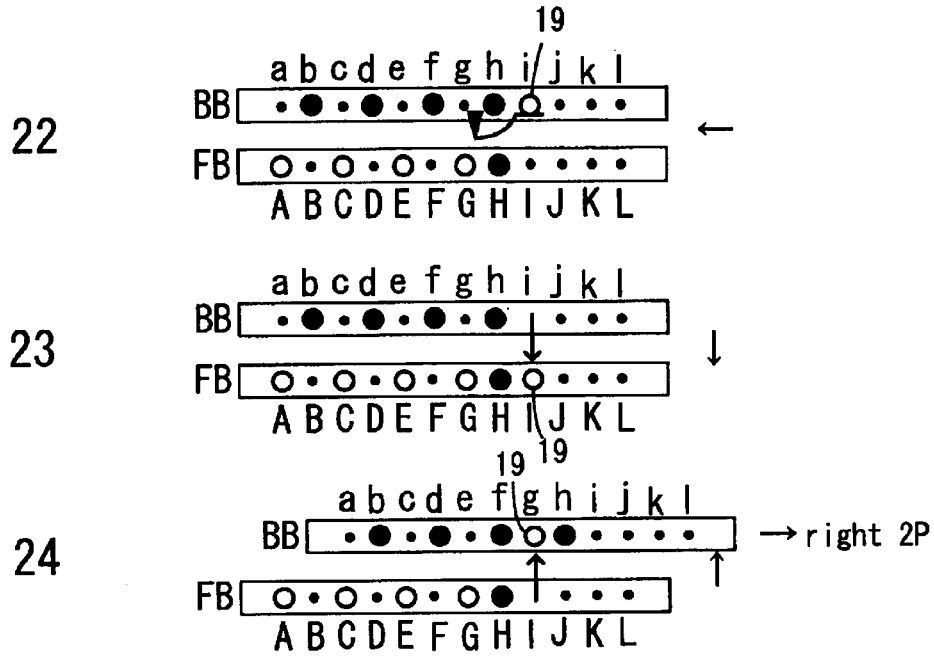
FIG. 5 is a knitting course diagram showing the first embodiment.

While in the embodiment illustrated above, the knitting for binding off the 2×2 rib knitted fabric has been described above, a knitted fabric having a different rib-knitted structure can also be bound off by dividing the loops of the final course of the rib knitted part into the state of the course 8 of FIG. 3. For the 1×1 rib knitted fabric, the knitting is performed in the state in which the loops are alternately arranged on the needles of the front and back needle beds which is the same as the state that the loop transfer in the course 8 of FIG. 3 is completed. Accordingly, there is no need of the processes of the courses 5–8 to alternately divide the loops of the final course of the knitted fabric into the first needle bed and the second needle bed. Further, the construction of the parts may be varied or modified without departing from the spirit of the invention. Although in the embodiment illustrated above, the tubular knitting is performed after the rib knitted part and before the binding-off process, the tubular knitting is not indispensable. Although in the embodiment illustrated above, the row of binding-off loops are formed by yarn of finer count than the yarn used for the knitting of the rib knitted part, a reduced number of yarn ends or an elastic yarn, such as woolly nylon, may be used, rather than the use of the yarn of fine count.

Second Embodiment

Referring to FIGS. 8–14 showing knitting course diagrams, a second embodiment according to which a 2×1 rib structure is knitted is described. In the second embodiment as well, the belt-shaped fabric shown in FIG. 1 is knitted. The 2×1 rib knitting is knitted with the needles of the front and back needle beds shifted in phase by 0.5 pitch (with rightward phase difference of 0.5 pitch). In the course 1 of FIG. 8, final loops of the rib knitted part are retained on the needles of the front and back needle beds. In the course 2, the loops on the needles a, d, g, j of the back needle bed BB are transferred to the needles A, D, G, J of the front needle bed FB. In the course 3, after the back needle bed is racked leftwards one pitch, the loops as were transferred in the course 2 are transferred to the needles b, e, h, k of the back needle bed BB, respectively. In the following description, the final loops retained on the front needle bed FB are called "loops of the front loop group" and depicted by white circles. Similarly, the final loops retained on the needles of the back needle bed BB are called "loops of the back loop group" and depicted by black circles.

In the course 4, a yarn is fed to the needle I of the back needle bed BB retaining thereon a loop 31 of the back loop group at the right end via a yarn feeder 30 for feeding yarn of finer count than the yarn used for knitting the rib knitted part, to form a binding-off loop 32 of a first row of binding-off loops. In the course 5, the loop 32 formed in the course 4 is transferred to the needle M of the front needle bed FB. In the course 6, the yarn is fed to the needle M of the front needle bed FB to form a loop 33 of the next course. In the course 7, the loop 33 formed in the course 6 is transferred to the needle I of the back needle bed BB. In the course 8, after the back needle bed BB is racked leftwards two pitches, the loop 33 is transferred to the needle I of the front needle bed FB to overlap a final loop 34 of the knitted fabric. In the next course 9, after the back needle bed BB is racked back to the original position, the yarn is fed to the needle L of the front needle bed FB retaining thereon a loop 35 of the front loop group at the right end, to form a first binding-off loop 36 of a second row of binding-off loops. In the course 10, the loop 36 formed in the course 9 is transferred the needle I of the back needle bed BB. In the course 11, the yarn is fed to the needle I of the back needle bed BB to form a next binding-off loop 37. In the course 12, the loop 37 formed in the course 11 is transferred to the needle L of the front needle bed FB. In the course 13, after the back needle bed BB is racked rightwards three pitches, the loop 37 formed in the course 11 is transferred to the needle i of the back needle bed BB to overlap it with a final loop 38 of the knitted fabric. In the next course 14, after the back needle bed BB is racked back to the original position, the yarn is fed to the needle k of the back needle bed BB retaining thereon a loop 39 of the back loop group, to form a first binding-off loop 40 of a third row of binding-off loops. In the course 15, after the back needle bed BB is racked rightward one pitch, the loop 40 formed in the course 14 is transferred to the needle L of the front needle bed FB. In the course 16, the yarn is fed to the needle L of the front needle bed FB to form a next binding-off loop 41. In the course 17, the loop 41 formed in the course 16 is transferred to the needle k of the back needle bed BB. In the course 18, after the back needle bed BB is racked leftwards three pitches, the loop 41 is transferred to the needle H of the front needle bed FB, to overlap it with a final loop 42 of the knitted fabric. In the course 19, the yarn is fed to the needle K of the front needle bed FB retaining thereon a loop 44 of the front loop group, to form a first binding-off loop 45 of a fourth row of binding-off loops. In the course 20, the loop 45 formed in the course 19 is transferred to the needle k of the back needle bed BB. In the course 21, the yarn is fed to the needle k of the needle bed BB, to form a binding-off loop 46 of the next course. In the course 22, the loop 46 formed in the course 21 is transferred to the needle K of the front needle bed FB. In the course 23, after the back needle bed BB is racked rightwards three pitches, the loop 46 formed in the course 21 is transferred to the needle h of the back needle bed BB, to overlap it with a loop 48 of the back loop group.

In the course 24, the yarn is fed to the double loop retained on the needle i of the front needle bed FB, to form a binding-off loop 51 following the first row of binding-off loops. In the course 25, after the back needle bed BB is racked rightwards one pitch, the loop 51 is transferred to the needle J of the front needle bed FB. In the course 26, a further next binding-off loop 52 is formed on the loop 51. In the course 27, the loop 52 is transferred to the needle i of the back needle bed BB. Further, in the course 28, the loop 52 is transferred to the needle F of the front needle bed FB, to overlap it with a loop 53 of the back loop group. In the course 29, the yarn is fed to the double loop retained on the needle I of the front needle bed FB, to form a binding-off loop 54 of the second row of binding-off loops. In the course 30, the loop 54 is transferred to the needle i of the back needle bed BB. In the course 31, a binding-off loop 55 is formed, and in the course 32, the loop 55 is transferred to the needle I of the front needle bed FB. In the course 33, after the back needle bed BB is racked leftwards three pitches, the loop 55 is transferred to the needle f of the back needle bed BB, to overlap it with a loop 56 of the front loop group. Sequentially, in the course 34, after the back needle bed BB is racked back to the original position, the yarn is fed to the double loop retained on the needle h of the back needle bed BB, to form a binding-off loop 57 of the next course in the third row of binding-off loops. In the course 35, after the back needle bed BB is racked rightwards one pitch, the loop 57 formed in the course 34 is transferred to the needle I of the front needle bed FB. In the course 36, a further next binding-off loop 58 is formed. In the course 37, the loop 58 is transferred to the needle h of the back needle bed BB. In the course 38, after the back needle bed BB is racked leftwards three pitches, the loop 58 is transferred to the needle E of the front needle bed FB, to overlap it with a loop 59 of the front loop group. In the course 39, after the back needle bed BB is racked back to the original position, the yarn is fed to the double loop retained on the needle H, to form a binding-off loop 60 of the next course in the fourth row of binding-off loops. In the course 40, the loop 60 is transferred to the needle h of the back needle bed BB. In the course 41, a next binding-off loop 61 is formed. In the course 42, the loop 61 is transferred to the needle H of the front needle bed FB. In the course 43, after the back needle bed BB is racked rightwards three pitches, the loop 61 is transferred to the needle e of the back needle bed BB, to overlap it with a loop 62 of the back loop group.

Subsequently, the knitting for forming the first row of binding-off loops shown in the courses 24–28, the knitting for forming the second row of binding-off loops shown in the courses 29–33, the knitting for forming the third row of binding-off loops shown in the courses 34–38, and the knitting for forming the fourth row of binding-off loops shown in the courses 39–43 are repeatedly performed along the go-forward direction of the binding-off process, while the loop to be knitted is changed in sequence. As a result of the knitting mentioned above, with the needles K, L of the front needle bed FB and the needles k, l of the back needle bed BB as the origins in the course 4, the four rows of binding-off loops are bound off in such a manner that they are extended in zigzag to the front loop group and the back loop group and are intersected therewith.

In the knitted fabric bound off by the knitting mentioned above, the binding-off loops 33, 37, 41, 46, 52, 55, 58, 61 are overlapped in such a manner that they are located on the underside of the final loops 34, 38, 42, 48, 53, 56, 59, 62 of the knitted fabric when the knitting of the knitted fabric is completed. Thus, the binding-off loops 33, 37, 41, 46, 52, 55, 58, 61 are hidden under the final loops 34, 38, 42, 48, 53, 56, 59, 62 of the knitted fabric. Thus, the binding-off loops different in orientation do not come out on the front side of the knitted fabric at a terminal end thereof. Also, he final loops of the knitted fabric included in the front loop group and the final loops of the knitted fabric included in the back loop group are intersected with each other and pulled closer to each other to close the gap therebetween.

While in the embodiment illustrated above, four rows of binding-off loops are formed with four loops as the origins, this is not limitative. It is enough that at least two rows of binding-off loops are formed with the loops on the needles L and I, which are loops of the wales at the lateral sides of the front loop group and the back loop group at the ends of the knitted fabric, as the origins. When at least three rows of binding-off loops are formed as in the illustrated embodiment, the rows of the binding-off loops are intersected with each other in a complicated manner, so that the binding-off loops of the rows of binding-off loops can be hidden in a more reliable manner. The binding-off process of the present invention is applicable to other knitted fabrics having other knitting structures, such as a 1×1 rib knitting structure and a 2×2 rib knitting structure, as well as the knitted fabric of the 2×1 rib knitting structure in the second embodiment,.

Capabilities of Exploitation in Industry

According to the present invention, the binding-off loops different in orientation do not come out on the front side of the knitted fabric at a terminal end thereof, so that the bound off part formed is similar in appearance to the set-up part and also is excellent in stretch.

What is claimed is:

1. A knitted fabric bound off by forming rows of binding-off loops in such a manner that a binding-off loop of a row of binding-off loops formed following a final loop of a rib knitted fabric with a predetermined number of front loops and back loops arranged alternately is overlapped with an adjacent final loop to form a double loop and a binding-off loop of a row of binding-off loops formed following the double loop continue from one end of a binding-off region to the other end thereof, wherein the loop of the row of binding-off loops is formed with finer yarn than yarn used in the rib knitted fabric part, and wherein the binding-off loop of the row of binding-off loops formed following the final loop of an odd wale of the knitted fabric at an end thereof and the binding-off loop of the row of binding-off loops formed following the final loop of an even wale of the knitted fabric are overlapped with the adjacent final loops on the underside thereof and also the binding-off loop formed following the final loop of the odd wale and the binding-off loop formed following the final loop of the even wale are intersected with each other.

2. The knitted fabric according to claim 1, wherein the binding-off loop is formed with yarn of finer yarn count than the yarn used for knitting the rib knitted part or with yarn smaller in number of yarn ends than the yarn used for knitting the rib knitted part.

3. The knitted fabric according to claim 1 wherein the binding-off loop is formed with elastic or stretch yarn.

4. A binding-off process of a rib knitted fabric at an end thereof using a flat knitting machine comprising at least a pair of first and second needle beds which are displaced opposite to each other in front and back and have each a large number of needles, between which a needle bed gap is formed, and at least either of which is racked laterally, and at least one yarn feeder for feeding yarn to the needles of the needle beds, the binding-off process comprising the steps:

(1) of dividing loops of the rib knitted fabric into a first loop group retained on needles of the first needle bed and a second loop group retained on needles of the second needle bed; and (2) of repeating at least the following steps a, b, c starting at one lateral end of the knitted fabric:

a) of feeding finer yarn than used for the rib knitted part to a needle on the first needle bed retaining a final loop of the first loop group and to a needle on the second needle bed retaining a final loop of the second loop group, to form next new loops on those needles;

b) of transferring a binding-off loop formed following a loop of the first loop group and a binding-off loop formed following a loop of the second loop group between the first and second needle beds in such a manner as to be bound with each other, so that they are intersected with each other; and c) of overlapping a binding-off loop formed following the loop of the first loop group with an adjacent loop of the first loop group and overlapping a binding-off loop formed following the loop of the second loop group with-an adjacent loop of the second loop group.

5. A binding-off process of a rib knitted fabric at an end thereof using a flat knitting machine comprising at least a pair of first and second needle beds which are displaced opposite to each other in front and back and have each a large number of needles, between which a needle bed gap is formed, and at least either of which is racked laterally, and at least one yarn feeder for feeding yarn to the needles of the needle beds, the binding-off process comprising the steps:

(1) of dividing loops of a final course of the rib knitted fabric into a first loop group retained on needles of the first needle bed and a second loop group retained on needles of the second needle bed;

(2) of forming at least two rows of binding-off loops by using finer yarn than yarn used for the rib knitted part, with at least a final loop of the first loop group in a wale of the knitted fabric at a lateral end thereof and a final loop of the second loop group in the wale of the knitted fabric at the lateral end thereof as origins; and (3) of overlapping the binding-off loops, which are formed in such a manner that while the rows of binding-off loops are formed, the rows of the binding-off loops are extended in zigzag from the first loop group to the second loop group and vise versa and intersected with each other, with the opposite final loops of the knitted fabric.

6. The binding-off process according to claim 4, wherein the knitted fabric is a tubular fabric with its first knitted fabric and second knitted fabric knitted to be continuously joined at both ends thereof, and wherein while the first knitted fabric is bound off, the final loop of the second knitted fabric is held on either of the first and second needle beds so that the first knitted fabric can be knitted, and after completion of the binding-off process of the first knitted fabric, the second knitted fabric is bound off.

* * * * *